US007251446B2

(12) United States Patent
Yoshida

(10) Patent No.: US 7,251,446 B2
(45) Date of Patent: Jul. 31, 2007

(54) FUSER AND IMAGE FORMING APPARATUS

(75) Inventor: Tatsuho Yoshida, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/367,378

(22) Filed: Mar. 6, 2006

(65) Prior Publication Data

US 2006/0204293 A1 Sep. 14, 2006

(30) Foreign Application Priority Data

Mar. 11, 2005 (JP) ..... 2005-069300

(51) Int. Cl.
*G03G 15/20* (2006.01)

(52) U.S. Cl. ..... 399/329; 399/328; 399/330; 219/619; 219/676

(58) Field of Classification Search ..... 399/329, 399/328, 330
See application file for complete search history.

(56) References Cited

U.S. PATENT DOCUMENTS 6,340,810 B2 * 1/2002 Yokoyama et al. ..... 219/619

FOREIGN PATENT DOCUMENTS

JP 11-231697 8/1999

OTHER PUBLICATIONS

Fujita, Takeshi, Aug. 1999, JP 11231697 A, translation of published document provided.*

* cited by examiner

*Primary Examiner*—David M. Gray
*Assistant Examiner*—Bryan Ready
(74) *Attorney, Agent, or Firm*—Rabin & Berdo, PC

(57) ABSTRACT

To control a surface temperature of a heating element to be an appropriate fusing temperature, a fuser comprises a supporter having a core metal at least, a heating element supported by the supporter, a magnetic field generator for generating a magnetic field to render the heating element generate heat with induction heating, and a gap retainer disposed at the magnetic field generator, brought in contact with the supporter, for retaining a gap between the supporter and the magnetic field generator.

17 Claims, 7 Drawing Sheets

(b)

FUSER AND IMAGE FORMING APPARATUS

BACKGROUND OF THE INVENTION

1. Field of the Invention

This invention relates to a fuser and an image forming apparatus.

2. Description of Related Art

With a conventional image forming apparatus, such as a photocopier, a printer, a facsimile machine, an MFP (Multi Function Peripherals), or the like, for example, with a conventional printer, a surface of a photosensitive drum is charged equally and uniformly to form an electrostatic latent image thereon upon exposure, thereby forming a toner image upon attachment of a toner on the electrostatic latent image. The toner image is transferred onto a paper and thereafter fused with a fuser to form an image.

The fuser comprises a fusing roller serving as a heating element having a built-in halogen heater, and a pressure roller coming in contact with the fusing roller in a pressing manner, in which the toner of the toner image is heated as fused with the fusing roller, thereby being pressed onto the paper with the pressure roller, and as a result, the toner image is fused onto the paper.

A thermistor is brought in contact with the fusing roller to detect a surface temperature of the fusing roller.

In a power supply circuit of the printer, a current supplied from a power supply to the halogen heater is controlled upon supplying a control signal from a CPU to a triac. The CUP generates, where receiving a sensor output transmitted from the thermistor, the control signal in a manner to set the surface temperature of the fusing roller to be such a fusing temperature as previously set, thereby supplying the control signal to the triac.

In the meanwhile, the halogen heater is to be energized only when using the printer whereas being nonenergized upon breaking the current when not using the printer to reduce energy consumed for the fuser. The printer of this type, however, employs the halogen heater as a heat source, thereby requiring a long period until when the surface temperature of the fusing roller reaches a set temperature.

Therefore, such a fuser has been provided, as heating the fusing roller upon induction heating (see, e.g., Japanese Patent Laid-Open No. H11-231697)

FIG. 2 is a cross-sectional view of the conventional fuser employing an induction heating method.

In FIG. 2, numeral 11 is a fusing roller comprising a core metal, not shown, and an elastic layer formed outside the core metal. Numeral 13 is a magnetic field generator having a core 13*a*, a coil 13*b* wound around the core 13*a*, and securing members 14 disposed at both ends of the core 13*a*. A predetermined gap is formed between the fusing roller 11 and the magnetic field generator 13, with a roller 12 rotatably disposed at each of the securing members 14.

Furthermore, numeral 15 is a pressing supporter for supporting in a shakable manner as pressing the magnetic filed generator 13 against the fusing roller 11. Numeral 16 is a spring for urging the magnetic field generator 13 toward a side of the fusing roller 11. Numeral 17 is a power supply connected to the coil 13*b*, for supplying the current thereto. Numeral 18 is a pressure roller for applying pressure on the fusing roller 11, for forming nip area N. Numeral 19 is a thermistor for detecting a surface temperature of the fusing roller 11. Additionally, numeral 20 is a paper.

The core metal of the fusing roller 11 functions as an induction heating element to allow an eddy current to pass therethrough in a case where the magnetic field generator 13 generates a magnetic field upon current supply to the coil 13*b*, and as a result, Joule heat is generated to heat the fusing roller 11.

With the conventional fuser as described above, it is necessary to retain an appropriate value of the gap between the core metal and the magnetic field generator 13, but an elastic layer formed outside the core metal, against which the roller 12 is pressed, expands with heat to undesirably push out the roller 12 in a radially outward direction in a case where a temperature becomes high.

As a result, the gap between the core metal and the magnetic field generator 13 becomes wider as the elastic layer expands, and the core metal reduces in heating value thereof to make it difficult to control the fusing roller 11 in a manner to set the surface temperature thereof to an appropriate fusing temperature.

This invention aims to solve such problems as described above and to provide a fuser and an image forming apparatus capable of controlling the heating element in a manner to set a surface temperature thereof to an appropriate fusing temperature.

SUMMARY OF THE INVENTION

The fuser according to the present invention for achieving the above stated purpose has a supporter having a core metal at least, a heating element supported by the supporter, a magnetic field generator for generating a magnetic field to render the heating element generate heat with induction heating, and a gap retainer disposed at the magnetic field generator, brought in contact with the supporter, for retaining a gap between the supporter and the magnetic field generator.

In this case, the gap can be retained even where heat expansion is caused due to heating of the heating element since the gap retainer is disposed at the magnetic field generator, in contact with the supporter. It is therefore possible to control the heating element in a manner to set a surface temperature thereof to an appropriate fusing temperature.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF PREFERRED EMBODIMENTS OF THE INVENTION

Hereinafter, specific embodiments of this invention will be described in detail in reference with drawings. Explained in this case is a printer which is exemplified as an image forming apparatus.

Figure 3:
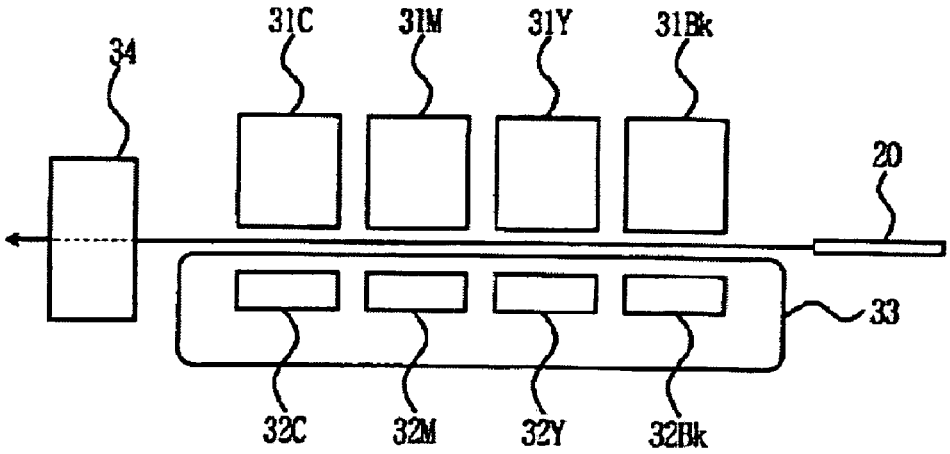
FIG. 3 is a conceptual view showing a printer according to the first embodiment of this invention.

FIG. 3 is a conceptual view showing a printer according to the first embodiment of this invention.

In FIG. 3, numeral 20 is a paper as a recording medium. Notations 31Bk, 31Y, 31M, and 31C are image forming units for forming images in black, yellow, magenta, and cyan colors, respectively. Notations 32Bk, 32Y, 32M, and 32C are transfer rollers serving as a transfer member. Numeral 33 is a conveyance belt serving as a conveyance member for conveying the paper 20, and numeral 34 is a fuser.

Each of the image forming units 31Bk, 31Y, 31M, and 31C has a photosensitive drum serving as an image bearing body, not shown, a charging roller, not shown, serving as a charging device for charging a surface of the photosensitive drum equally and uniformly, a developing roller, not shown, serving a developer bearing body for forming a toner image as a developer image onto an electrostatic latent image formed on the surface of the photosensitive drum, a developer supplying unit, not shown, for supplying a toner as a developer, and a cleaning device, not shown, for cleaning up the toner remaining on the photosensitive drum. Furthermore, disposed as facing to each of the image forming units 31Bk, 31Y, 31M, and 31C is an exposure device which exposes the surface of the photosensitive drum charged with the charging roller, to form the electrostatic latent image thereon.

The transfer rollers 31Bk, 32Y, 32M, and 32C sequentially transfer the toner images in respective colors formed on the photosensitive drums onto the paper 20, respectively, to form a colored toner image, thereby conveying the paper to the fuser 34. The fuser 34 fuses the colored toner image onto the paper 20, thereby forming an colored image.

The fuser 34 is described next.

Figure 1:
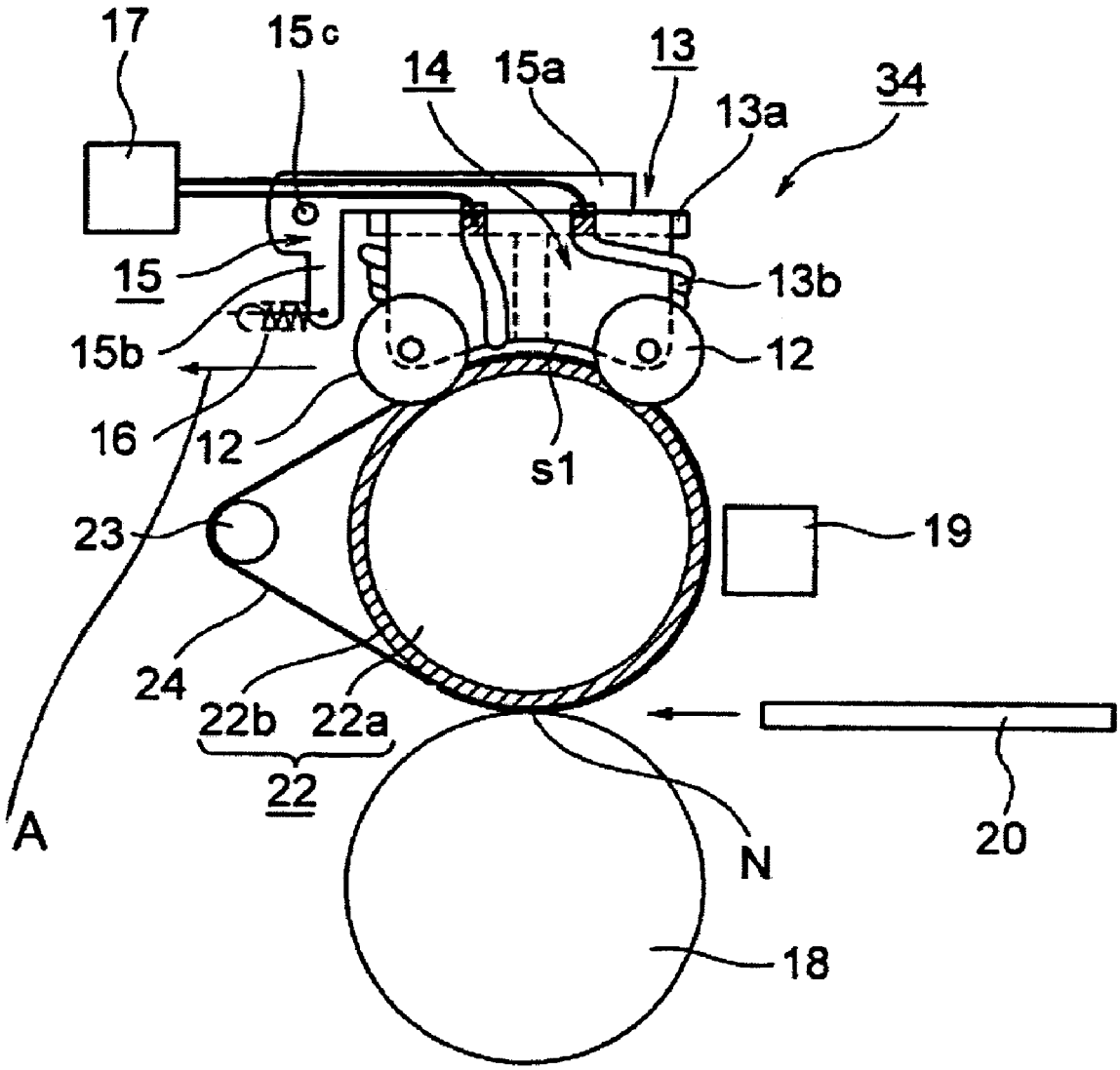
FIG. 1 is a cross-sectional view of a fuser according to the first embodiment of this invention.
Figure 2:
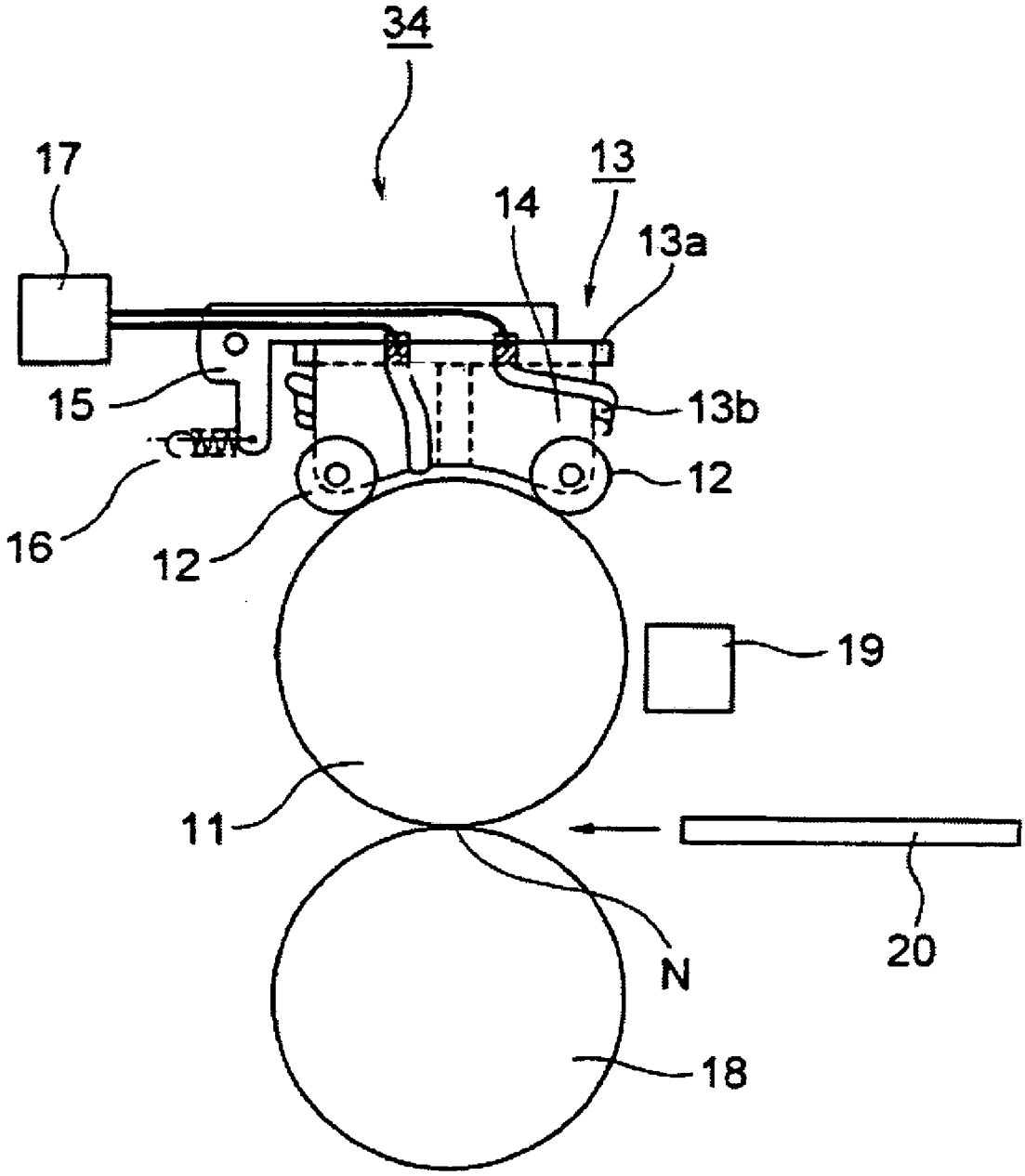
Fig. 2 Prior Art
FIG. 2 is a cross-sectional view of a fuser employing an induction heating method.
Figure 4:
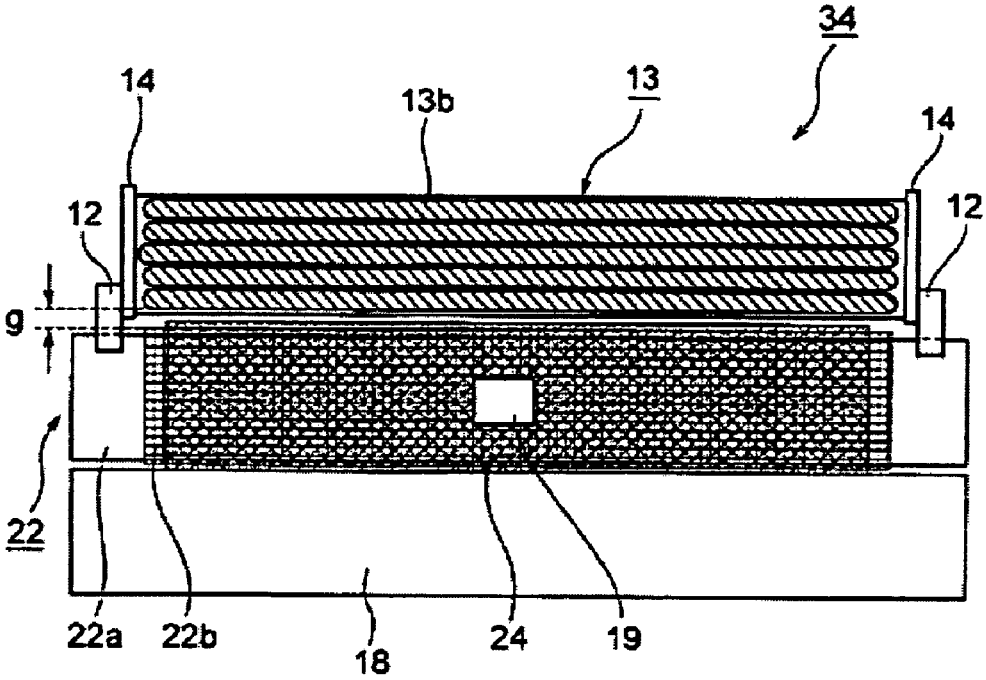
FIG. 4 is a front view of the fuser according to the first embodiment of this invention.
Figure 5:
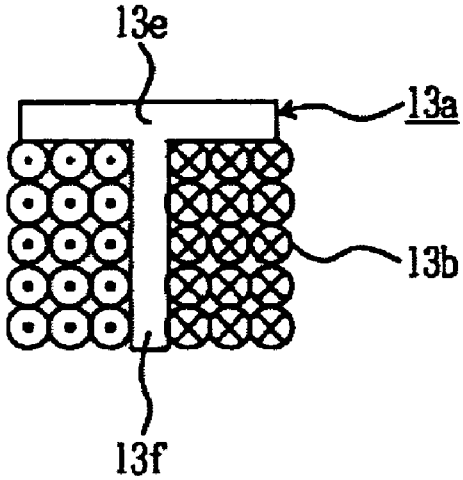
FIG. 5 is a cross-sectional view of a magnetic field generator according to the first embodiment of this invention.
Figure 6:
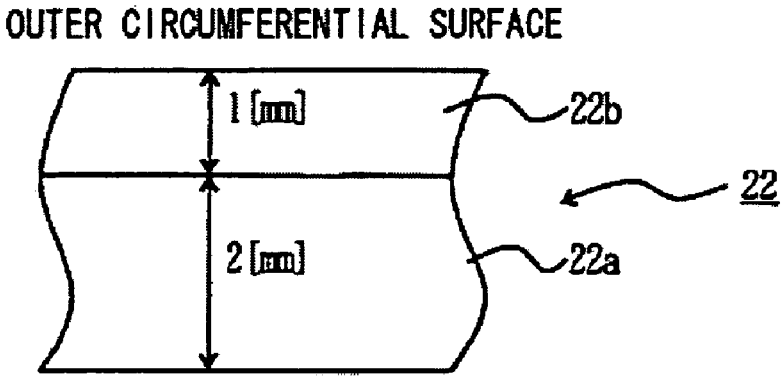
FIG. 6 is a view showing a layer structure of a supporting roller according to the first embodiment of this invention.
Figure 7:
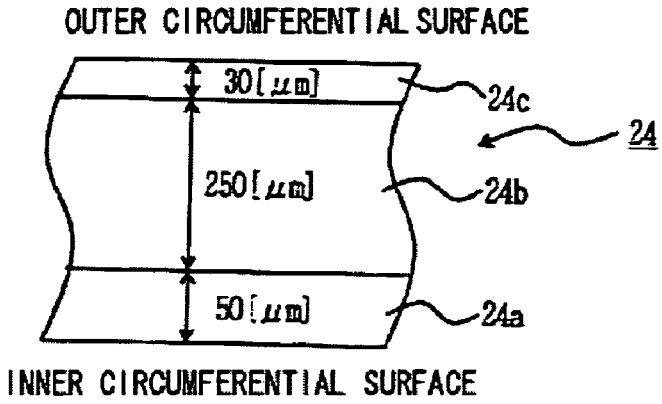
FIG. 7 is a view showing a layer structure of a fusing belt according to the first embodiment of this invention.

FIG. 1 is a cross-sectional view of a fuser according to the first embodiment of this invention. FIG. 4 is a front view of the fuser according to the first embodiment of this invention. FIG. 5 is a cross-sectional view of a magnetic field generator according to the first embodiment of this invention. FIG. 6 is a view showing a layer structure of a supporting roller according to the first embodiment of this invention. FIG. 7 is a view showing a layer structure of a fusing belt according to the first embodiment of this invention.

In Figs, numeral 20 is a paper, and numeral 22 is a supporting roller in a roller shape serving as a supporter disposed in a rotatable manner and as a first roller. Numeral 23 is a tensile roller in a roller shape made of metal such as iron, serving as a supporter rotatably disposed at a predetermined distance from the supporting roller 22 and as a second roller. Numeral 24 is a fusing belt serving as a heating element made of a seamless belt member, supported with the supporting roller 22 and the tensile roller 23, disposed as tensioned therebetween in a freely driven manner. Numeral 18 is a pressure roller serving as a third roller for applying pressure on the supporting roller 22 through the fusing belt 24 to form nip area N. The number of disposed tensile rollers 23 is only one in this embodiment but may be more than two.

As shown in FIG. 6, the supporting roller 22 has a core metal 22*a* made of paramagnetic metal such as aluminum, composing an inner layer having a thickness of approximately 2 [mm], and a heat insulating layer 22*b* formed at an outer circumference of the core metal 22*a*, made of a heat insulator such as a silicone sponge, having a thickness of approximately 1 [mm]. Therefore, heat generated at the fusing belt 24 is hardly transmitted to the fusing roller 22, thereby flowing along the surface of the fusing belt 24.

Furthermore, numeral 13 is a magnetic field generator having a core 13*a*, a coil 13*b* wound around the core 13*a*, and securing members 14 disposed at both ends of the core 13*a*, for generating a magnetic field to render the fusing belt 24 generate heat with induction heating. To form and support predetermined gap g between the supporting roller 22 and the magnetic field generator 13, the magnetic field generator 13 has such a surface s1 thereof facing to the fusing belt 24, as formed in a concave shape corresponding to a curve of the fusing belt 24, and a pair of rollers 12 serving as a gap retainer and as a rotary body are rotatably disposed in contact with the supporting roller 22, at portions facing to the supporting roller 22 at both ends of the securing members 14. The roller 12 is formed of paramagnetic metal such as aluminum or nonmagnetic material such as ceramics. It is to be noted that the gap g is such as formed between an outer circumferential surface of the supporting roller 22, i.e., an inner circumferential surface of the fusing belt 24, and the surface s1, i.e., a lower end of the coil 13*b*. A size of the gap g is determined based on a control circuit of the magnetic field generator 13, a property of the fuser 34, and so on.

The core 13*a* is composed of high-magnetic permeability material such as ferrite and has a horizontal portion 13*e* and a vertical portion 13*f*, as shown in FIG. 5. Furthermore, the coil 13*b* is formed by binding and twining 100 copper wires having a diameter of 0.02 [mm] and is wound around the vertical portion 13*f*. In the meanwhile, the coil 13*b* is secured to the core 13*a* by being impregnated with a silicone resin or the like.

Numeral 15 is a pressing supporter for supporting in a shakable manner as pressing the magnetic field generator 13 against the supporting roller 22, and numeral 16 is a spring serving as an urging member for urging the magnetic field generator 13 toward a side of the supporting roller 22. The pressing supporter 15 has a first arm 15*a* running along an upper surface of the magnetic field generator 13, a second arm 15*b* running in a direction perpendicular to the first arm 15*a*, and a pivot 15*c*. The spring 16 is disposed between a front end of the second arm 15*b* and a main body of the printer, not shown. The spring 16 urges the second arm 15*b* in a direction of arrow A, thereby rendering the pressing supporter 15 press the magnetic field generator 13 against the supporting roller 22.

Numeral 17 is a power supply connected to the coil 13*b*, for supplying the current to thereto. Numeral 19 is a thermistor serving as a temperature detector for detecting a surface temperature of the fusing belt 24.

The fusing belt 24 is composed of a heating layer 24*a* made of ferromagnetic metal such as iron, nickel, magnetic stainless, or the like, composing an inner layer having a thickness of approximately 50 [μm], an elastic layer 24*b* made of an elastic member such as silicone rubber, composing a middle layer having a thickness of approximately 250 [μm], and a top-coating layer 24*c* made of a member having a high melted-toner repellent property, such as a perfluoroalkyl vinyl ether copolymer resin, composing an outer layer having a thickness of approximately 30 [μm].

The fusing belt 24 is tensioned with the supporting roller 22 and the tensile roller 23 so a surface thereof as not to become wavy due to rotation, and thus the gap g is not changed due to the wavy surface thereof.

In this embodiment, in the meanwhile, the core metal 22*a* has end portions exposed to an outside since the heat insulating layer 22*b* is axially shorter than the core metal 22*a*, as shown in FIG. 4. Furthermore, the heat insulating layer 22*b* has end portions exposed to the outside since the fusing belt 24 is axially shorter than the heat insulating layer 22*b*. The exposed end portions of the core metal 22*a* include such portions not formed with the heat insulating layer 22*b*, as brought in contact with the rollers 12, respectively.

Operation of the fuser 34 thus structured is described next.

In this case, a controller of the printer, not shown, starts printing operation upon reception of printing data from a host apparatus, not shown. The controller supplies a current (an alternating current) of 50 [kHz] to the coil 13*b* to generate the magnetic field at the magnetic field generator 13, thereby heating the fusing belt 24 with heating of the heating layer 24*a* to set a temperature enough to fuse the toner, for example, to 180 degrees Celsius. Furthermore, the controller starts to drive the fusing belt 24 at the same time when starting to heat the fusing belt 24.

When reaching the conveyance belt 33 in FIG. 1, the paper 20 fed with the feeder, not shown, is absorbed as attached thereto, thereby being conveyed at the same conveyance speed as a driven speed of the conveyance belt 33. When the paper 20 reaches each of the image forming units 31Bk, 31Y, 31M, and 31C, the toner image on each of the photosensitive drums of the image forming units 31Bk, 31Y, 31M, and 31C is transferred onto the paper 20 at the timing controlled by the controller, using each of the transfer rollers 32Bk, 32Y, 32M, and 32C, thereby forming the colored toner image.

The paper 20 on which the colored toner image is transferred is separated from the conveyance belt 33, thereby being fed to the fuser 34. The colored toner image is fused onto the paper 20 at the fuser 34, thereby forming the colored image. The paper 20 is subsequently discharged out of the main body of the apparatus, so that the printing operation is completed.

In the meanwhile, the pressure roller 18 is rotated with a motor used for fusing operation, serving as a driving unit, not shown, at the time of heating the fusing belt 24, so that the fusing belt 24 is driven in association with rotation of the pressure roller 18. The supporting roller 22 is then rotated in association with driving of the fusing belt 24. Furthermore, each of the rollers 12 keeps the gap g constant as rotating in association with rotation of the supporting roller 22.

Where the power supply 17 supplies a current to the coil 13*b*, a magnetic field is generated, and thus a magnetic flux flows through the core 13*a* and the heating layer 24*a* of the fusing belt 24. An eddy current is therefore caused at the core 13*a* and the heating layer 24*a* but is small in amount and does not generate heat because of the core 13*a* of high resistance. On the other hand, the heating layer 24*a* is of low resistance, so that the eddy current caused thereat is large in amount and generates heat with Joule heat. The thermistor 19 detects and transmits a surface temperature of the fusing belt 24 to the controller. The controller controls the power supply 17 in a manner to set the detected surface temperature to a fusing temperature. In the meanwhile, the supporting roller 22 does not generate heat since the core metal 22*a* is composed of paramagnetic metal so a magnetic flux as not to flow therethrough. Furthermore, the roller 12 is also formed of paramagnetic metal or nonmagnetic material not to allow a magnetic flux to flow therethrow, thereby not generating heat. The magnetic flux therefore flows through the heating layer 24*a*, not the core metal 22*a* nor the roller 12, so that the heating layer 24*a* generates heat effectively. Furthermore, the roller 12 is brought in contact with the core metal 22*a* made of paramagnetic metal, thereby not being heated. Thus, the gap g can be prevented from changing due to heat expansion of the roller 12.

As described above, the roller 12 is brought in contact with the core metal 22*a* of the supporting roller 22 supporting the fusing belt 24, not with the fusing belt 24 directly, thereby not being pushed radially outwardly even in a case of heat expansion of the elastic layer 24*b* and the top-coating layer 24*c* in association with heating of the heating layer 24*a*, so that the gap g can be retained in this embodiment. Therefore, the fusing belt 24 can be controlled in a manner to set a surface temperature thereof to an appropriate fusing temperature.

It is to be noted that an outer circumferential surface of the heating layer 24*a* is radially shifted due to heat expansion in association with heating of the heating layer 24*a*, so that a gap between the outer circumferential surface of the heating layer 24*a* and the surface s1 narrows. Thus, a heating value can be increased at the heating layer 24*a*.

The fusing belt 24 does not get damaged since the roller 12 is not brought in contact with the fusing belt 24. Therefore, the fusing belt 24 can be improved in durability. Furthermore, localized pressure is not applied to the fusing belt 24, thereby being able to prevent the fusing belt 24 from having any deflection.

In the meanwhile, in this embodiment, the gap g fluctuates during a rotation period of the roller 12 in a case where the roller 12 is deteriorated and decentered due to rotation in association with the supporting roller 22 and to reception of radiant heat from the fusing belt 24, so that a surface temperature of the fusing belt 24 fluctuates to result in uneven gloss of the colored image.

The second embodiment is described next, in which the gloss of the colored image can be uniformed. It is to be noted that the elements substantially the same as those in the first embodiment are assigned with the same reference numbers so that those duplicated description are omitted, and description for the first embodiment is quoted for the effects resulted from the structures substantially the same as the first embodiment.

Figure 8:
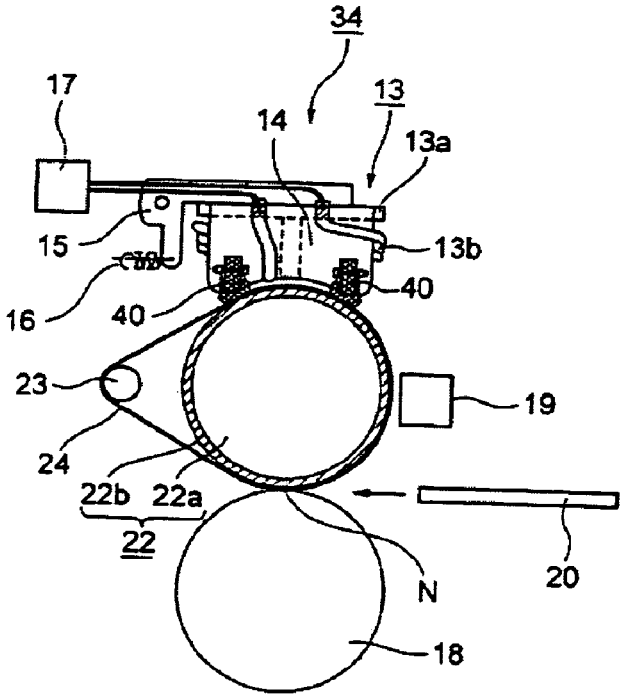
FIG. 8 is a cross-sectional view of the fuser according to the second embodiment of this invention.
Figure 9:
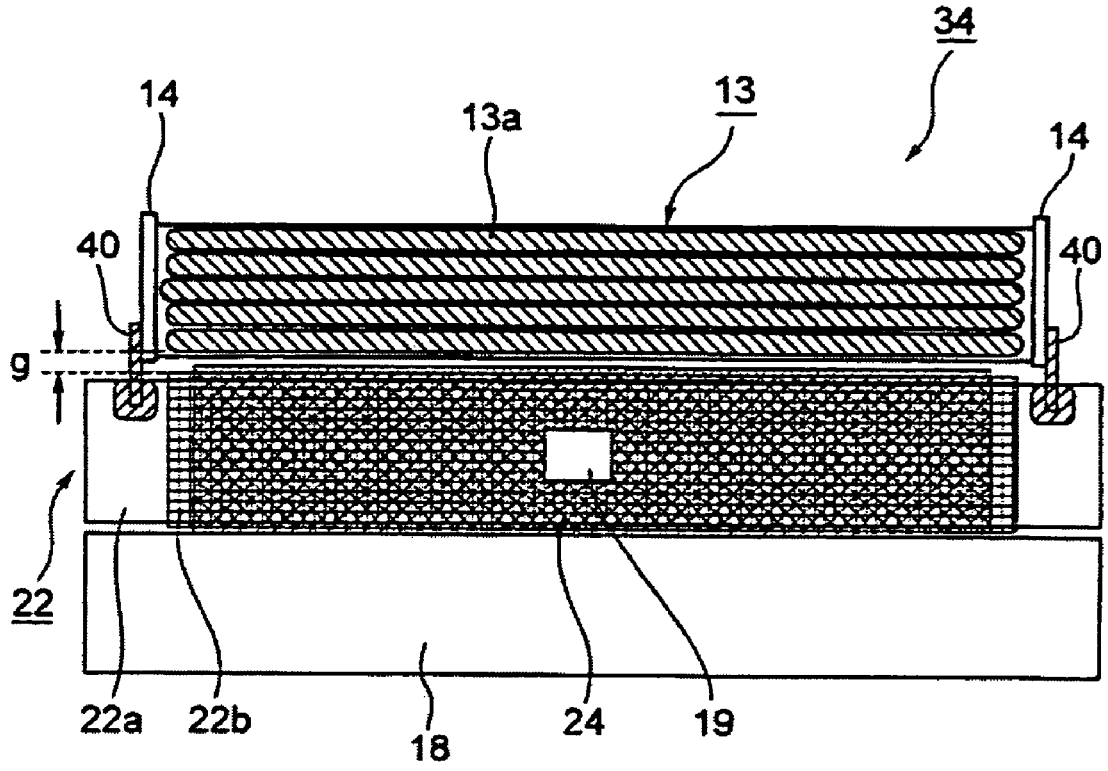
FIG. 9 is a front view of the fuser according to the second embodiment of this invention.
Figure 10:
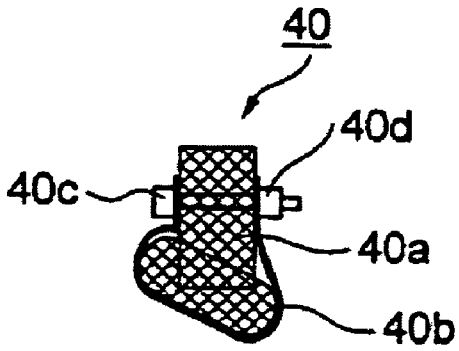
FIG. 10 is a cross-sectional view of a sliding member according to the second embodiment of this invention.

FIG. 8 is a cross-sectional view of the fuser according to the second embodiment of this invention. FIG. 9 is a front view of the fuser according to the second embodiment of this invention. FIG. 10 is a cross-sectional view of a sliding member according to the second embodiment of this invention.

Figure 11:
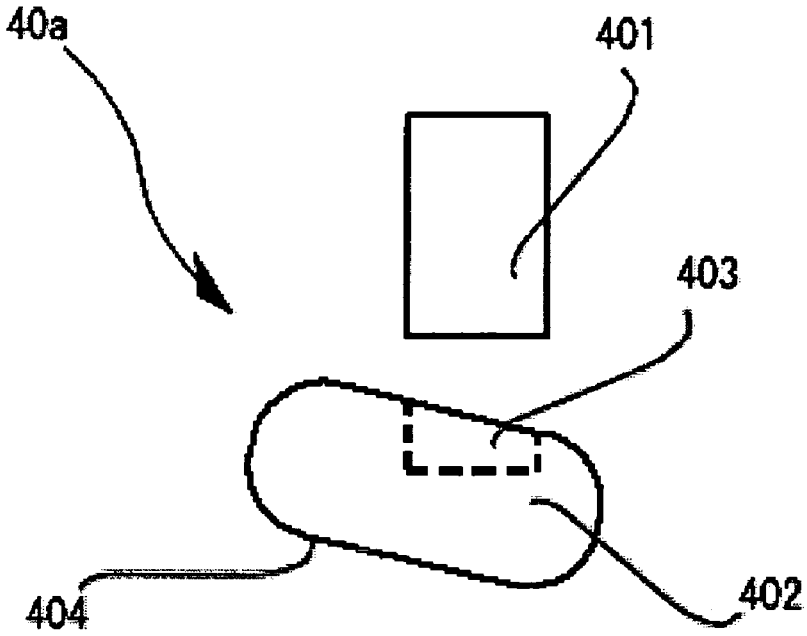
FIG. 11 is an exploded view of a core member according to the second embodiment of this invention.

In this case, a pair of sliding members 40 serving as a gap retainer is disposed at the securing member 14. The sliding member 40 has the a core member 40*a* made of paramagnetic metal such as aluminum or nonmagnetic material such as ceramics, a sliding element 40*b* disposed as surrounding the core member 40*a* to form a sliding surface, and a screw 40*c* and a nut 40*d* for mounting the sliding element 40*b* to the core member 40*a*. The sliding element 40*b* has a durability and an abrasion resistant property and is formed with a glass fiber impregnated with a fluorine resin. FIG. 11 is an exploded view of a core member according to the second embodiment of this invention. The core member 40*a* is constituted from a pole member 401 supported with the securing member 14 and a contact base 402 having a contact surface 404 coming in contact with a surface of the core metal 22*a* through the sliding element 40*b* in FIG. 10. The pole member 401 is inserted in a hole 403 formed in the contact base 402, thereby forming core member 40*a*.

The sliding member 40 thus structured comes in contact with the surface of the core metal 22*a* of the supporting roller 22 serving as the first roller and retains the gap g as sliding.

As described above, the sliding member 40 does not rotate in this embodiment, so that the gap g does not fluctuate periodically even where the roller 12 is deteriorated due to rotation in association with the supporting roller 22 and to reception of radiant heat from the fusing belt 24 as a heating element. Therefore, a surface temperature of the fusing belt 24 does not fluctuate and thus the gloss of the image color can be uniformed.

It is to be noted that the present invention is not limited to the above described embodiment but can be arbitrarily modified based on the purpose of this invention, and those modifications are not excluded from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A fuser comprising:

a supporter comprising a core metal;

a heating element supported by said supporter;

a magnetic field generator for generating a magnetic field to generate heat in said heating element with induction heating; and a gap retainer comprised in said magnetic field generator, said gap retainer being brought into contact with an outer surface of said core metal of said supporter to retain a gap between said supporter and said magnetic field generator.

2. The fuser according to claim 1, wherein said supporter comprises a heat insulating layer formed on the outer surface thereof.

3. The fuser according to claim 1, wherein said supporter is formed in a roller shape and rotated in association with driving of said heating element.

4. The fuser according to claim 1, wherein said core metal is constituted from a paramagnetic material.

5. The fuser according to claim 1, wherein said gap retainer is brought in contact with an end portion, in axial direction, of said supporter.

6. The fuser according to claim 1, wherein said heating element comprises a fusing belt disposed in a freely driven manner.

7. The fuser according to claim 1, wherein said heating element comprises a heating layer and a top-coating layer.

8. The fuser according to claim 1, wherein said gap retainer comprises a rotary body rotatably disposed to rotate in association with rotation of said supporter.

9. The fuser according to claim 1, wherein said gap retainer comprises a sliding member.

10. An image forming apparatus comprising said fuser according to claim 1.

11. The fuser according to claim 1, wherein said magnetic field generator is facing the outer surface of said supporter.

12. The fuser according to claim 1, wherein said gap retainer is made from a paramagnetic material or a nonmagnetic material.

13. The fuser according to claim 2, wherein said heat insulating layer is shorter than said core metal in the axial direction of said supporter, and wherein end portions of said core metal are exposed.

14. The fuser according to claim 13, wherein said gap retainer is in contact with the exposed end portions of said core metal.

15. The fuser according to claim 1, wherein said gap retainer is pressed into contact with the exposed end portions of said core metal.

16. The fuser according to claim 15, comprising a spring to press the gap retainer.

17. The fuser according to claim 1, comprising a spring to urge the magnetic field generator toward the supporter.

* * * * *